US005802626A

United States Patent [19]

Bedana

[11] Patent Number: 5,802,626

[45] Date of Patent: Sep. 8, 1998

[54] FOOT-OPERATED DEVICE FOR FLUSHING VALVE OF A WALL-MOUNTED URINAL

[76] Inventor: Ramon C. Bedana, 5 Massey Square, Apartment 1410, Toronto, Ontario, Canada, M4C 5Z6

[21] Appl. No.: 944,802

[22] Filed: Oct. 6, 1997

[51] Int. Cl.[6] ..... E03D 13/00

[52] U.S. Cl. ..... 4/308

[58] Field of Search ..... 4/249, 308, 405, 4/408, 409; 251/295

[56] References Cited

U.S. PATENT DOCUMENTS

| | | | |
|---|---|---|---|
| 2,467,019 | 4/1949 | Farson | 4/308 |
| 3,883,904 | 5/1975 | Wittman | 4/249 |
| 4,868,931 | 9/1989 | Schneeweiss | 4/308 |
| 5,068,925 | 12/1991 | Salibi | 4/405 X |

*Primary Examiner*—Charles E. Phillips

[57] ABSTRACT

A foot-operated device for the flushing valve of a wall-mounted urinal is shown. The device has a spring-biassed vertical rod which is connected to a pivot bar installed at the flushing valve of the urinal. The flushing valve may be actuated by a foot pedal provided at the lower end of the vertical rod. All components of the device is located in a spaced manner from the washroom floor such that they are not subject to contamination by water and other corrosive substances that are present on the washroom floor.

14 Claims, 2 Drawing Sheets

FOOT-OPERATED DEVICE FOR FLUSHING VALVE OF A WALL-MOUNTED URINAL

BACKGROUND OF THE INVENTION

This invention relates to a foot-operated device adaptable to the flushing valve of a wall-mounted urinal for operating the valve. More particularly, it relates to a device for easily converting an existing hand-operated flushing valve of a wall-mounted urinal to foot-operated.

Urinals, particularly the wall-mounted types, are commonly provided with a manual flushing valve located above the urinal and having a pivotable handle which may be operated for flushing the urinal. The structure of such valve is partially shown in FIG. 3 of the drawings. It comprises of a slider which is maintained in a normally shut off position by a compression spring. The slider is pushed to an open position when a T-shaped handle is pivoted so as to allow water to pass through the valve for flushing the urinal. Such hand-operated flushing valve is generally considered by users for being inconvenient to operate due to the mere fact that the user does not have any free hand to operate the handle either during urination or while he is straightening his clothing after urination. Accordingly, after finishing urination, in order to flush the urinal, he must diligently operate the valve handle before leaving from the urinal. Such task demands the user to perform work, and it also inherently delays the user from leaving from the urinal. Either due to the user's laziness or in his haste to depart from the urinal, such work demanding chore is often ignored either intentionally or unintentionally, resulting in that the urinal is often not flushed after use. Furthermore, many users, in fact, refrain from operating the handle so as to avoid potentially acquiring by touch any unsanitary matters and/or bacteria left on the handle by the previous users.

The above problem may be solved with the provision of a foot-operated flushing mechanism which may be operated by the user during urination or while the user is preparing to leave the urinal such that it does not delay the user's departure and thus the flushing operation may be accomplished involuntarily.

An adaptor for converting the hand-operated flushing valve to foot-operated is shown in U.S. Pat. No. 5,068,925 to S. Kamal Salibi. The adaptor shown therein consists of mounting an extension tubing to the operating handle of the valve and connecting the tubing to a foot pedal assembly located on the floor adjacent to the urinal through an elongated rod. The extension tubing is secured to the handle by a set screw which could easily become dislodged after a short period of time in use and rendering the arrangement inoperative. Furthermore, since the foot pedal assembly therein is located on the floor, it is subject to contamination by water and other corrosive liquids and/or substances commonly present on the washroom floor, which can cause the foot pedal assembly to break down through rusting and/or mechanical deterioration, and it presents an obstruction on the washroom floor when the floor is being cleaned, thus making it difficult to clean the latter. Also, only a weak arc-shaped torsion spring is provided in the foot pedal assembly, which can easily break down after a short time of use particularly after it has been deteriorated with the contamination by water and corrosive liquids and substances in the washroom. Still furthermore, the elongated connecting rod is not restrained such that it can be easily damaged if accidentally pulled by the user, and moreover, due to the pivotal movement of the rod, it can potentially become dislocated from the assembly to swing forward to cause injury to the user or other person standing adjacent to the assembly.

SUMMARY OF THE INVENTION

It is a principal object of the present invention to provide a foot-operated device for the flushing valve of a wall-mounted urinal.

It is another object of the present invention to provide a device which can easily be adapted to an existing hand-operated flushing valve to convert it to foot-operated.

It is another object of the present invention to provide a foot-operated device for a urinal flushing valve, which is simple yet rugged in construction and is less likely subject to contamination by water and other corrosive liquids present in the washroom.

It is still another object of the present invention to provide a foot-operated device for the flushing valve of wall-mounted urinals mounted at various heights above the washroom floor.

Briefly, the foot-operated device of the present invention has a pivot rod member mounted to the flushing valve of the wall-mounted urinal and it is operative to actuate the flushing valve. When mounted to the flushing valve, the pivot rod member has a free end extending along the vertical wall on which the urinal is mounted for a short distance beyond the side of the urinal. A coupling member is pivotally secured to the free end of the pivot rod member. A restraining bracket member is adapted for mounting on the vertical wall. The restraining bracket member has a horizontal portion with an elongated opening formed therein. An elongated rod member is movably extending through the elongated opening of the restraining bracket member and it is adapted to position in a substantially vertical manner adjacent to the urinal. The elongated rod member has an upper end secured to the coupling member. A circular compression spring is movably mounted in a surrounding manner at the lower portion of the elongated rod member. An abutment pin member is mounted on the elongated rod member and is adapted to prevent the compression spring from moving up the elongated rod member. An abutment bracket member is mounted on the vertical wall, which has a retaining opening formed in a horizontal portion therein adapted to engage slidably with the lower portion of the vertical rod member. The lower end of the compression spring is in abutment with the abutment bracket member. A foot pedal is mounted at the lower end of the vertical rod member and it is positioned in a spaced manner above the ground.

DESCRIPTION OF THE DRAWINGS

Other objects of this invention will appear in the following description and appended claims, reference being made to the accompanying drawings forming a part of the specification wherein like reference numerals designate corresponding parts in the several views in which

DETAILED DESCRIPTION OF THE PREFERRED EMBODIMENTS

Figure 2:
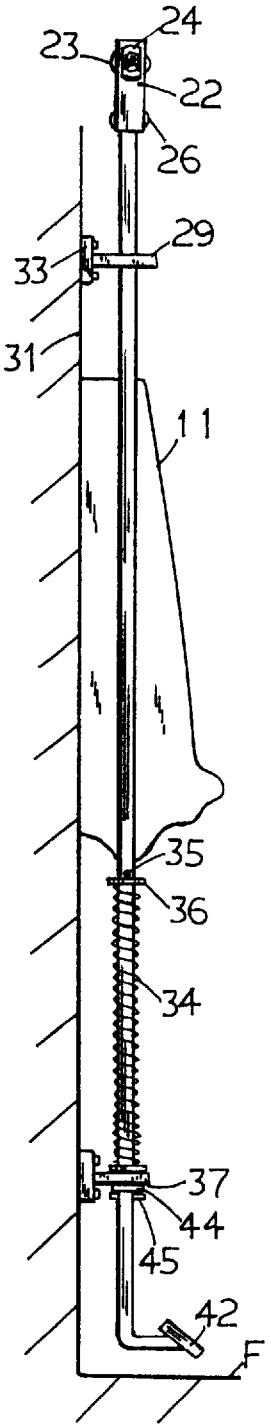
FIG. 2 is a side perspective elevation view thereof.
Figure 1:
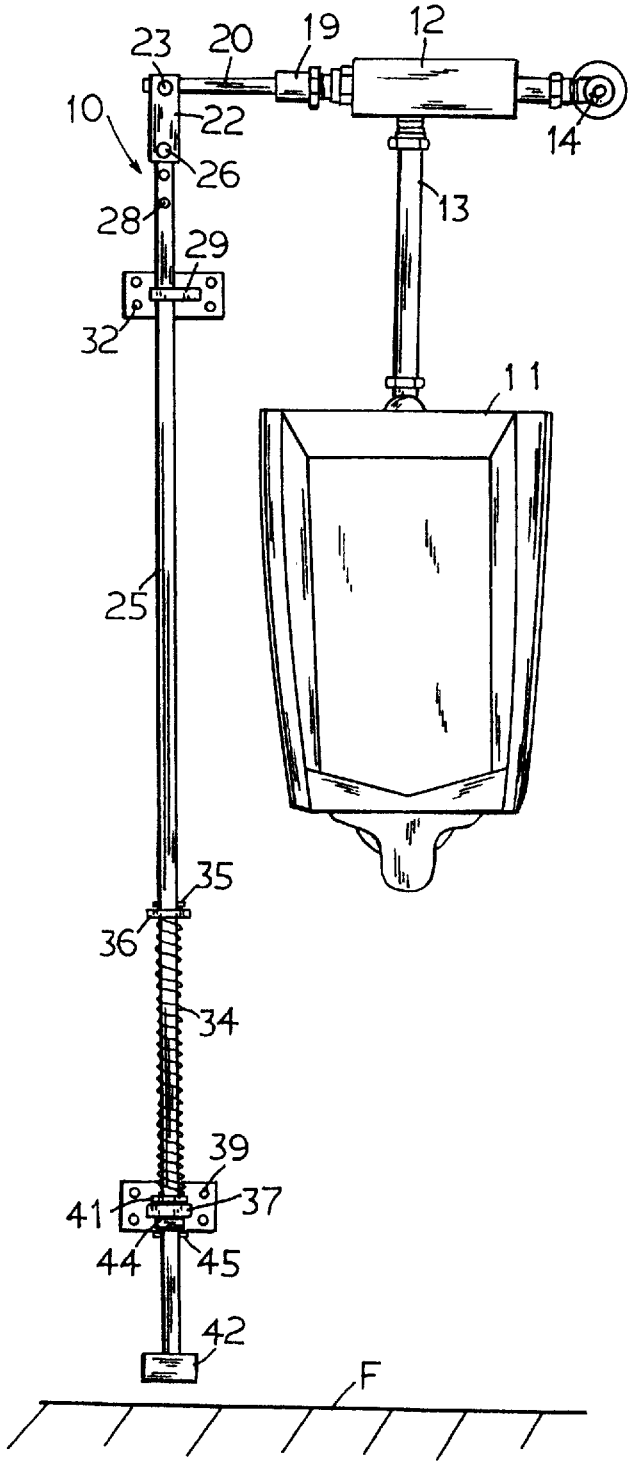
FIG. 1 is a front perspective elevation view showing the foot-operated device of a flushing valve for a wall-mounted urinal according to the present invention.
Figure 3:
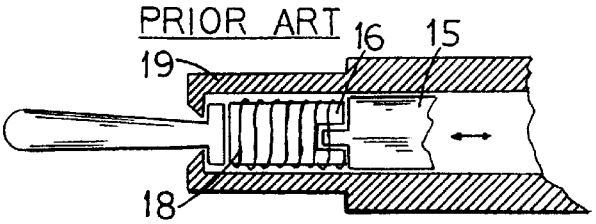
FIG. 3 is a partial sectional isolated front elevation view of a prior art hand-operated flushing valve for a wall-mounted urinal.

With reference to the drawings, the foot-operated device 10 is provided for the flushing valve of a wall-mounted urinal 11 which is provided with a hand-operated flushing valve 12 mounted above it through water pipe 13. The flushing valve 12 is connected to the water supply through coupling 14 in a well known manner. As best shown in FIG. 3 such hand-operated flushing valve 12 has a flushing assembly consisting of a slider 15 and a spacer 16 which may be actuated by a T-shaped handle when the latter is pivoted. The slider 15 is maintained in a normally closed position by a compression spring 18 positioned over the spacer 16. The flushing assembly is mounted in the flushing valve 12 by a cap 19 with mating threads provided on the body and the cap 19 such that the cap 19 may be threadingly removed to have access of the flushing assembly. The flushing valve 12 is operated by pivoting the handle so as to push the slider 15 to an opened position such that water passes through the valve to flush the urinal 11.

Figure 4:
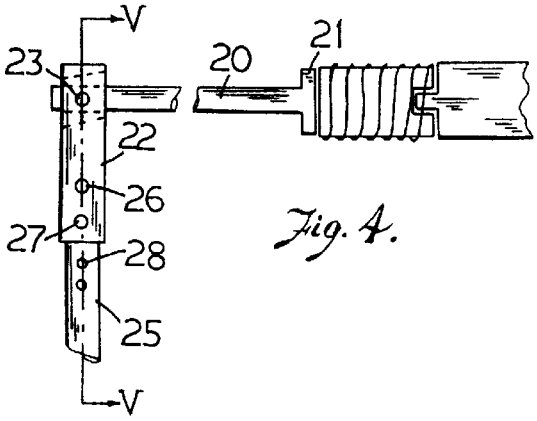
FIG. 4 is an isolated front elevation view showing the pivot rod connecting to the coupling cap of the vertical rod of the device according to the present invention.
Figure 5:
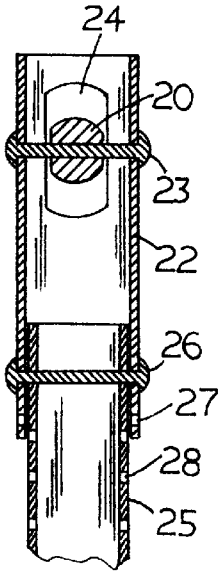
FIG. 5 is an enlarged isolated end elevation view along sectional line V—V of FIG. 4.
Figure 6:
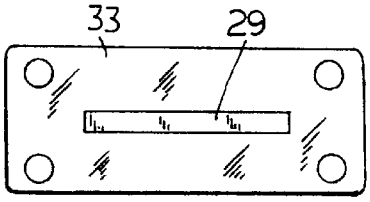
FIG. 6 is a front elevation view of the top restraining bracket for the device according to the present invention.
Figure 8:
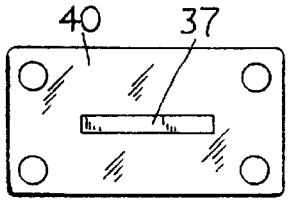
FIG. 8 is a front elevation view of the lower abutment bracket for the device according to the present invention.
Figure 10:
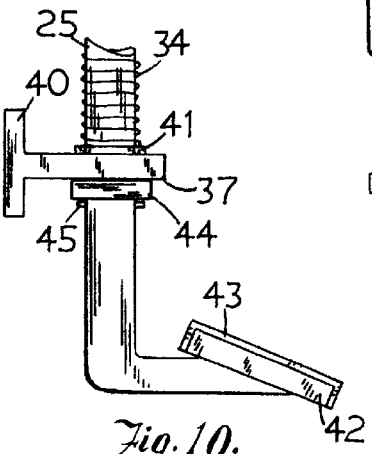
FIG. 10 is an isolated side elevation of the lower end portion of the vertical rod showing the provision of the bumper ring and the pedal with a cover provide thereon.
Figure 7:
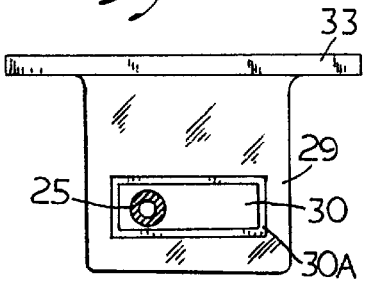
FIG. 7 is a top elevation view of the top restraining bracket.
Figure 9:
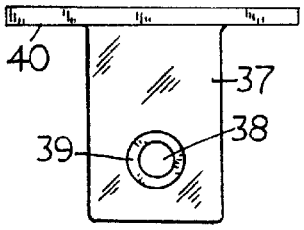
FIG. 9 is the top elevation view of the lower abutment bracket.

The foot-operated device 10 according to the present invention is provided with a pivot rod 20 which has a circular disc 21 at one end similar to that in, the handle of a hand-operated valve. The pivot rod 20 and the circular disc 21 have diameter similar to those of the handle of a hand-operated flushing valve 12 such that it can be easily installed onto the flushing valve 12 to replace the hand-operated handle. The pivot rod 20 has a selected length so that its free end extends a short distance beyond the side of the urinal when it is mounted to the flushing valve 12. The free end of the pivot rod 20 is pivotally connected to the upper end portion of a coupling cap 22 by a rivet or bolt 23 such that the pivot rod 20 and the coupling cap 22 may be pivoted with respect to each other at the connecting rivet 23. An open or elongated slot opening 24 is provided in the top portion to receive the end portion of the pivot rod 20 which may also be provided with two opposite flat sides as best shown in FIG. 5 to enhance the engagement between the two parts. The elongated slot 24 is formed in a slanted manner sloping downwards from the side facing the flushing valve 12 to the distal side as best shown by the dotted lines in FIG. 4 so as to allow for the pivotal movement of the pivot rod 20. An elongated vertical rod 25 is connected to the coupling cap 22. The elongated vertical rod 25 has an upper end secured to the lower end of the coupling cap 22 with rivet or bolt 26. A plurality of mounting openings 27 are provided in the coupling cap 22 and similarly a plurality of associated mounting openings 28 are provided in the upper portion of the vertical rod 25 such that the length of the vertical rod 25 may be varied in the field during installation by removing a selected portion of its upper end according to the height of the urinal mounted above the washroom floor.

A restraining bracket 29 slidably receives the upper portion of the vertical rod 25. The restraining bracket 29 has an elongated slot 30 which engages with the vertical rod 25 so that the vertical rod 25 may move substantially vertically and sideways freely within the elongated slot 30 during operation. The inner sidewalls of the elongated slot 30 may be provided with a lining 30A therein in order to enhance the free movement of the vertical rod 25 within the elongated slot 30. The restraining bracket 29 is fastened to the vertical wall 31 to which the urinal is mounted with mounting screws 32 or with high strength glue in the well known manner through its base plate 33 so that the vertical rod 25 can not dislodge from its vertical position during operation.

An elongated compression spring 34 is movably mounted over and surrounding the middle lower portion of the vertical rod 25. The compression spring 34 may be made of stainless steel so as to prevent it from rusting. The elongated compression spring 34 is prevented from sliding up the vertical rod 25 by a transverse pin 35 mounted on the vertical rod 25. A ring washer plate 36 is mounted on the vertical rod 25 and is located between the transverse pin 35 and the upper end of the compression spring 34 in order to ascertain that the upper end of the compression spring 34 would not damage the transverse pin 35 and vice versa under the compression pressure of the spring during operation.

An abutment bracket 37 is slidably mounted to the lower portion of the vertical rod 25 with the latter extending through an opening 38 provided in the abutment bracket 37. A lining sleeve 39 may be provided in the opening 38 to enhance the sliding engagement between the abutment bracket 37 and the vertical rod 25. The abutment bracket 37 is positioned at the lower end of the compression spring 34 and it is mounted to the vertical wall 31 by mounting screws 39 provided in the base plate 40 of the abutment bracket 37 or with high strength glue in the well known manner. A protective ring washer 41 slidably mounted on the vertical rod 25 may be provided and located between the lower end of the compression spring 34 and the abutment bracket 37.

A pedal 42 is provided at the lower end of the vertical rod 25. The pedal 42 is spaced from the floor F by removing the selected upper end portion of the vertical rod 25 in the field installation of the device as described above. A rubber cover 43 may provide over the pedal 42 to protect the pedal from corrosion as well as to prevent slipping when operated by foot. A bumper ring 44 is mounted on the vertical rod 25 and located juxtaposed to the underside of the abutment bracket 37 and it is retained in place by a transverse pin 45 secured to the vertical rod 25. The bumper ring 44 may be made of rubber or a rubberlike material such that it would absorb any impact in the vertical rod 25 when the foot is released and the force of the compression spring 34 returns the vertical rod to its normal position.

All component parts of the present device may be made of plastic, or stainless steel, or a metal with a surface chrome plating so as to reduce or eliminate the likelihood of rusting or corroding of these components due to the humid condition and the presence of water and other corrosive substances in the washroom.

The foot-operated device of the present invention may be conveniently operated by stepping on the foot pedal 42 so as to pull the pivot rod 20 downwards to actuate the flushing valve 12. The transverse pin 35 will urge the ring washer plate 36 to slide downwards to depress the compression spring 34 downwards such that when the foot pedal 42 is released the compression force will provide the biassing force to return the vertical rod 24, and in turn the pivot rod 20, to their normal positions to shut off the flushing valve 12. Since the foot pedal 42 and all the components of the device are spaced above the floor, they are not subject to contamination by water and other corrosive liquids commonly present on the washroom floor, and they do not obstruct the cleaning operation of the washroom floor. Furthermore, the compression spring is durable and requires minimum amount of maintenance.

While the preferred embodiments of the invention have been described above. It will be recognized and understood that various modifications may be made therein and the appended claims are intended to cover all such modifications which may fall within the spirit and scope of the invention. For example, the vertical rod 25 may have a circular shape as shown in the above illustration or it may have other cross sectional shapes such as square, oval or polygonal.

What I claim is:

1. A foot-operated device for the flushing valve for a urinal mounted above the ground of a washroom on a vertical wall, comprising a pivot rod member mounted to said flushing valve and operative for actuating the flushing operation of said flushing valve, said pivot rod member having a free end extending along said wall for a short distance beyond a side of said urinal, a coupling member having an upper end pivotally secured to said free end of said pivot rod member, a restraining bracket member adapted for mounting on said wall, an elongated opening formed in a horizontal portion of said restraining bracket member, said horizontal portion extending outwards from said vertical wall, an elongated rod member movably extending through said elongated opening of said restraining bracket member and adapted to be positioned in a substantially vertical manner adjacent to said urinal and be moved in a substantially vertical and lateral manner within said elongated opening, said elongated rod member having an upper end secured to said coupling member, and a lower end, a circular compression spring movably mounted in a surrounding manner at a lower portion of said elongated rod member, an abutment pin member mounted on said elongated rod member and adapted to prevent said compression spring from moving up said elongated rod member, an abutment bracket member mounted on said wall and having a retaining opening formed in a horizontal portion therein adapted to engage slidably with the lower portion of said elongated rod member, and the lower end of said compression spring being in abutment with said abutment bracket member, a foot pedal member mounted at the lower end of said elongated rod member and positioned in a spaced manner above the ground.

2. A foot-operated device according to claim 1 including a protective ring washer slidably mounted on said vertical rod member and positioned between the upper end of said compression spring and, said abutment pin member.

3. A foot-operated device according to claim 2 including a second protective ring washer slidably mounted on said vertical rod member and positioned between said abutment bracket member and the lower end of said compression spring.

4. A foot-operated device according to claim 3 including a sleeve member lining said retaining opening.

5. A foot-operated device according to claim 4 including a bumper ring mounted on said vertical rod member and located juxtaposed the underside of said abutment bracket member.

6. A foot-operated device according to claim 4 including a plurality of transverse openings formed in the lower end portion of said coupling member.

7. A foot-operated device according to claim 6 including a plurality of associated transverse openings formed in the upper end portion of said vertical rod member.

8. A foot-operated device according to claim 7 wherein said foot pedal member extends outwards from said wall.

9. A foot-operated device according to claim 8 including a protective cover disposed over said foot pedal member.

10. A foot-operated device according to claim 9 including an elongated slot opening formed in said coupling member.

11. A foot-operated device according to claim 10 wherein said elongated slot opening slopes downwards from the side facing the flushing valve to the distal side thereof.

12. A foot-operated device for operating the flushing valve for a urinal mounted above the ground on a vertical wall in a washroom, comprising a pivot rod member mounted to said flushing valve and operative for actuating the flushing operation of said flushing valve, said pivot rod member having a free end extending along said vertical wall for a short distance beyond the side of said urinal, said free end portion of said pivot rod member having two opposite flat vertical sides formed therein, a coupling member having an elongated slot opening formed in an upper end portion therein, said elongated slot opening being adapted for pivotal engagement with said free end portion of said pivot rod member, a restraining bracket member adapted for mounting on said vertical wall, an elongated opening formed in a horizontal portion of said restraining bracket member, and said horizontal portion extending outwards from said vertical wall, an elongated rod member movably and slidably extending through said elongated opening of said restraining bracket member and adapted to be positioned in a substantially vertical manner adjacent to said urinal and be moved in a substantially vertical and lateral manner within said elongated opening, said elongated rod member having an upper end secured to said coupling member, and a lower end, an elongated circular compression spring slidably mounted in a surrounding manner at a lower portion of said elongated rod member, a slider ring washer member slidably mounted on said elongated rod member and locating in abutment with the upper end of said compression spring, an abutment pin member mounted on said elongated rod member and located above said slider ring washer and adapted to prevent said compression spring from moving up said elongated rod member, an abutment bracket member mounted on said vertical wall and having a retaining opening formed in a horizontal portion therein and adapted to engage slidably with the lower portion of said elongated rod member, and the lower end of said compression spring being in abutment with said abutment bracket member, a shock absorbing bumper mounted on said elongated rod member and located below and juxtaposed with the underside of said abutment bracket member, a foot pedal member mounted at the lower end of said elongated rod member, said foot pedal member positioned in a spaced manner above the ground and extending outwards away from said vertical wall.

13. A foot-operated device according to claim 12 wherein said free end of said pivot rod member and said coupling member are mounted together by a rivet extending through said coupling member in a transverse manner.

14. A foot-operated device according to claim 13 including a protective cover disposed over said foot pedal.

* * * * *